United States Patent [19]

Moriya et al.

[11] 3,978,296

[45] Aug. 31, 1976

[54] SWITCHING SYSTEM FOR AN ELECTRONIC TIMEPIECE

[75] Inventors: Tokio Moriya, Chiba; Hirotomo Hirai, Tokyo, both of Japan

[73] Assignee: Kabushiki Kaisha Daini Seikosha, Japan

[22] Filed: Mar. 6, 1975

[21] Appl. No.: 556,121

[30] Foreign Application Priority Data

Mar. 7, 1974 Japan ..... 49-26656

[52] U.S. Cl. ..... 200/4; 58/4 A; 58/23 R; 58/50 R; 58/85.5; 200/6 R

[51] Int. Cl.[2] ..... H01H 9/00; H01H 19/10

[58] Field of Search ..... 58/4 A, 23 R, 50 R, 58/58, 85.5; 200/4, 6, 52 R

[56] References Cited

UNITED STATES PATENTS

| | | | |
|---|---|---|---|
| 3,733,803 | 5/1973 | Hiraga | 58/85.5 |
| 3,810,356 | 5/1974 | Fujita | 58/85.5 |
| 3,852,952 | 12/1974 | Vittoz | 58/23 R |

*Primary Examiner*—Edith Simmons Jackmon
*Attorney, Agent, or Firm*—Robert E. Burns; Emmanuel J. Lobato; Bruce L. Adams

[57] ABSTRACT

A switching system for an electronic timepiece has: a plurality of display sections which are individually activated in response to movement of manual member for effecting an amendment of said display sections. A switching mechanism is operated by axial movement and rotational movement of said manual member for effecting the desired amendment.

2 Claims, 6 Drawing Figures

SWITCHING SYSTEM FOR AN ELECTRONIC TIMEPIECE

BACKGROUND OF THE INVENTION

This invention relates to a switching system for an electronic timepiece, said switching system having a switching mechanism which is operated by axial movement or rotation of a manual member.

In a conventional type of electronic timepiece which has a switching system, a number of the operative switching buttons are used equivalent in number to the number of display sections for amending the digital watch. Further the operative switch buttons for indicating the amending figure, a fast forward button and a safety switch for preventing action in case of mistouch are respectively mounted to said digital watch, accordingly the number of the operative button becomes larger, and the operative characteristic becomes lower.

OBJECT OF THE INVENTION

The present invention aims at eliminating the above noted difficulty and insufficiency, and therefore it is the primary object of the present invention to provide a switching system for an electronic timepiece, said switching system having at least three kinds of actuation of the switching mechanism which is operated by axial movement and the rotation of the manual member for effecting the desired amendment.

Further object of this invention is to provide a timepiece having a compact switching system which is readily available to the consumer.

SUMMARY OF THE INVENTION

According to the present invention, there is a switching system for an electronic timepiece comprising a plurality of display factors, and a manual member for effecting amendment of the desired display factor or for effecting the amendment and the other operation of said display factor. A switching mechanism is operated in response to axial movement or rotational movement of said manual member for effecting the amendment.

BRIEF DESCRIPTION OF THE DRAWINGS

The above mentioned and further objects, features and advantages of the present invention will become more apparent from the following description when taken in connection with the accompanying drawings which show one preferred embodiment of the invention, and wherein.

DETAILED DESCRIPTION OF THE INVENTION

Figure 1:
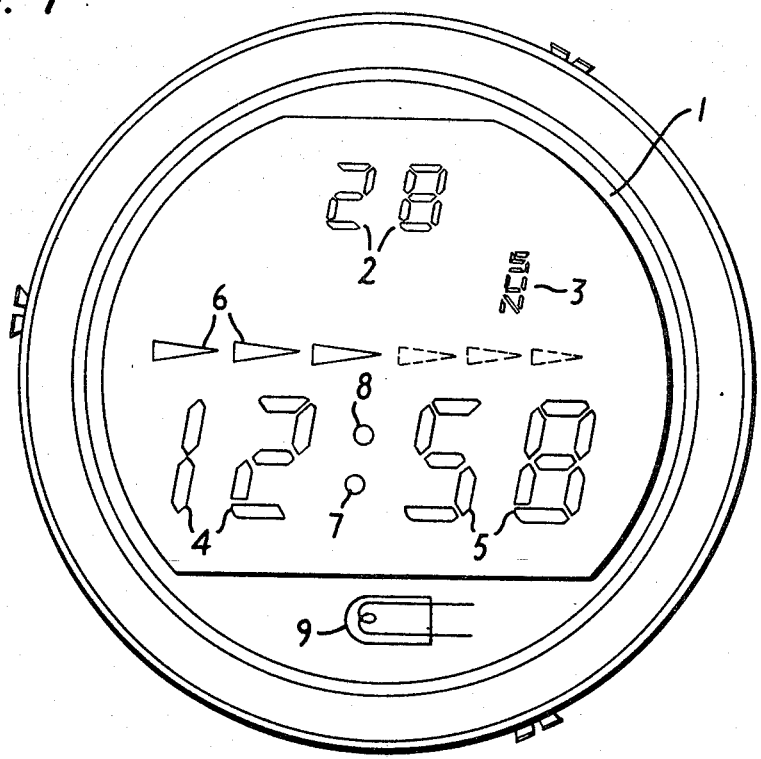
FIG. 1 shows a top plan view of a watch having a liquid crystal display panel in accordance with this invention.

Referring now to the accompanying drawings, FIG. 1 shows one example of a liquid crystal display panel, comprising a panel 1, a date display section 2, a day of the week display section 3 which displays Sunday, Monday, Tuesday . . . Saturday in sequence from the left hand side. The display panel further includes a minute display section 5, a second display section 6 which has six arrow marks. In said second display section, the display of time in 0 to 9 seconds is displayed by the flashing of the left hand arrow mark at one second intervals, and the display of time in 10 to 19 seconds is displayed by the continuous lighting of said left hand arrow mark and the flashing of the second arrow mark at one second intervals. In a similar manner, the remaining seconds are displayed by said six arrow marks. A dot 7 is provided for distinguishing between the hour display figure and the minute display figure, and a PM dot 8 is provided which is displayed in afternoon and not displayed in forenoon. A lamp 9 is disposed for lighting said panel from side portion.

Figure 2:
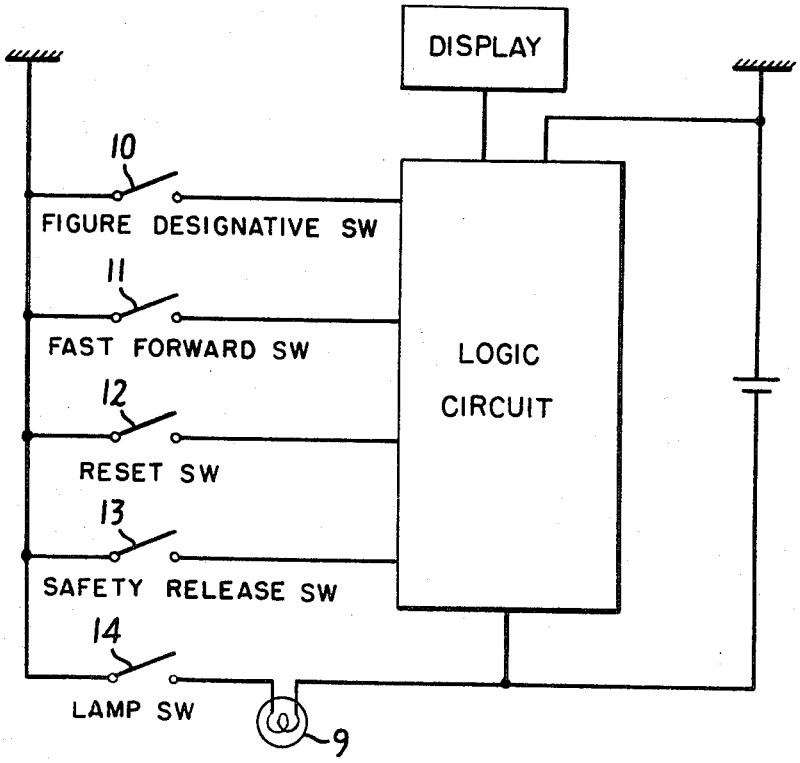
FIG. 2 shows a block diagram of the electronic circuit for the watch of this invention.

FIG. 2 shows an electronic circuit diagram for performing the various switching functions and comprises a switch 10 for the designation of the figure as well as to designate a certain amendment of the figure.

Numeral 11 is a fast forward switch which enables amendment or adjustment of the designated figure by the figure designative switch 10.

Numeral 12 is a reset switch which functions to effect the zero return of the second display section, effect the release of the designation in the amending figure and the duty of the safety switch, further said reset switch 12 effects the release of the designation in the amending figure and the safety switch after the action of said figure designative switch 10 and the zero return and the safety switch before the action of said figure designative switch 10.

Numeral 13 is the safety release switch which, when returned to the ON position, then the action of said designated switch 10 for amending the figure, said fast forward switch 11 and said reset switch 12 are activated in the operational state and further said active situation is maintained until said reset switch is turned to the OFF position. Numeral 14 is a lamp switch which functions, when in the ON position, to turn on the lamp 9.

Figure 3:
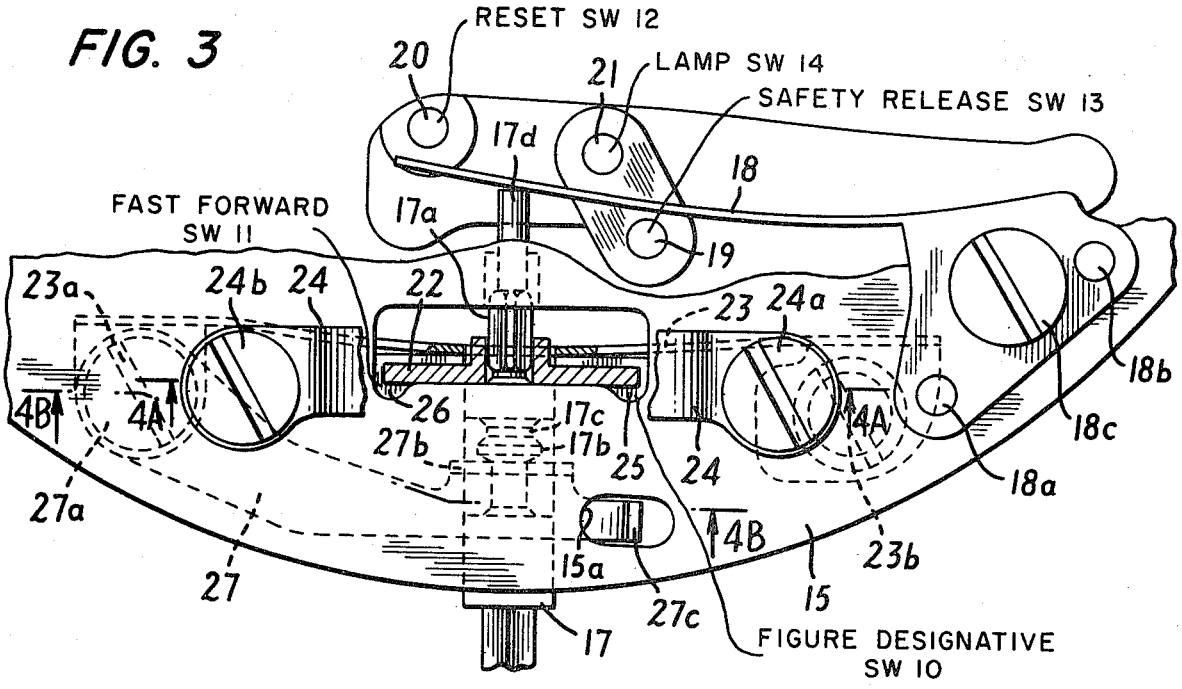
FIG. 3 shows a top plan view, partly in section, of a part of the electronic watch of this invention, FIGS. 4 A and B shows a cross sectional view of a part of the electronic watch of this invention.
Figure 4A:
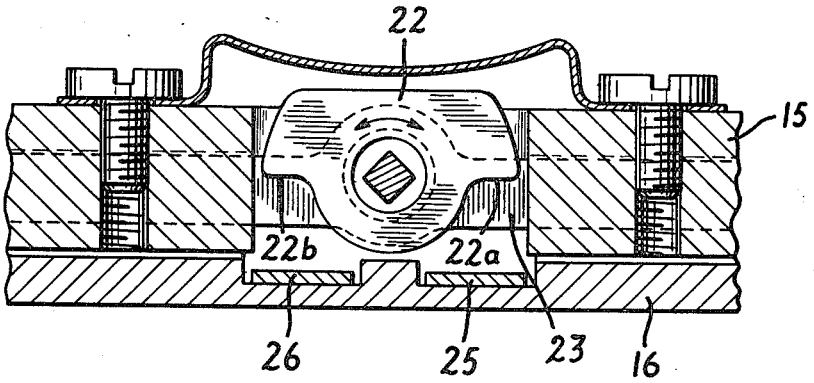
Figure 4B:
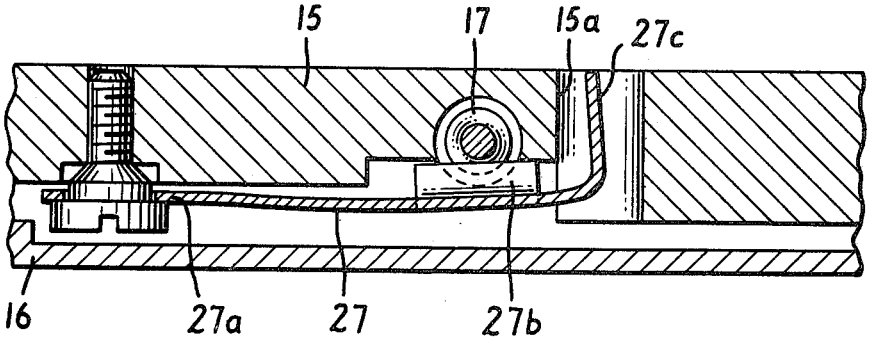

FIG. 3 shows a top plan view of the switch mechanism and, FIG. 4 shows a cross sectional view of said switch mechanism. In these drawings, numeral 15 is a metal base plate which is electrically grounded, numeral 16 is a printed circuit board and numeral 17 is the manual member which is mounted to rotate and to move in an axial direction on said base plate.

A switch spring 18 is composed of electrically conductive material and has end portions 18*a* and 18*b* which are positioned by pins and an end portion 18*c* which is fixed to said base plate 15 and makes electrical contact therewith by a screw bolt. The switch spring 18 exerts a spring force against the end 17*d* of the manual member 17. Numeral 19 is a safety release switch pin which is fixed to the printed portion of said printed circuit board 16. Safety release switch 13 is composed of the safety release switch pin 19 and said switch spring 18 and the switch 13 is closed when said switch spring 18 contacts said pin 19.

Numeral 20 is a reset switch pin which forms part of said reset switch 12. Said reset switch 12 is composed of said reset switch pin 20 and said switch spring 18.

Numeral 21 is a lamp switch pin which is fixed to said printed portion of said printed circuit board 16. Said lamp switch 14 is composed of said lamp switch pin 21 and said switch spring 18. When said switch spring 18 contacts the pin 21, said lamp switch 14 is closed. Numeral 22 is an amending wheel which is mounted on a square portion 17*a* of the manual member 17 and is made from an electrically conductive material. Said amending wheel 22 is mounted to move in an axial direction along the square portion 17*a* and is mounted to undergo movement with said square portion 17*a* in a rotary direction. Numeral 23 is a returning spring for said manual member and one end portion 23*a* of said returning spring 23 is fixed to said base plate 15 by a screw bolt and the other end portion 23*b* of said returning spring 23 is likewise mounted to said base plate 15 by a screw bolt. The end portion 23*b* of said returning spring 23 is movably mounted for lengthwise movement relative to said base plate 15 so that when said manual member is pushed inwardly, then said manual member is returned to its normal rest position by the biasing action of said returning spring 23. Numeral 24 is an amending wheel spring, the ends of which are fixed to said base plate by a screw bolt, and said spring 24 is pushed up to its upper position by the rotation of said amending wheel 22 whereupon said spring 24 exerts a spring force in the downward direction.

Numeral 25 is a switch electrode for a figure designation which is mounted on said printed circuit board 16, said figure designative switch 10 is composed of said switch electrode 25 and said amending wheel 22. When said amending wheel 22 contacts said switch electrode 25, then said figure designative switch 10 is closed. Numeral 26 is a fast forward switch electrode which is mounted on said printed circuit board 16. Said fast forward switch 11 is composed of said switch electrode 26 and said amending wheel 22. When said amending wheel 22 contacts said switch electrode 26, then said fast forward switch 11 is closed.

Numeral 27 is a defense member for said manual member 17, and an end portion 27*a* of said defense member 27 is fixedly mounted to said base plate 15, a first protrusion 27*c* of said defense member 27 is located adjacent a long hole 15*a* in said base plate 15 so that the horizontal movement of said defense member 27 is defensed, and a second protrusion 27*b* exerts a force for pressing said manual member 17.

The operation of this invention will now be described. In case of effecting the amendment of "the figure in hour," when said manual member 17 is pulled out, then said protrusion 17*b* pushes up said protrusion 27*b* which exerts a spring force in the axial direction. Said protrusion 27*b* moves with click action until said protrusion 27*b* touches the wall 17*c* of said manual member 17, at that time said switch spring 18 exerts a spring force to the left hand side in FIG. 3 by said end portion 17*d* of said manual member 17 which moves to the left hand side. Then said switch spring 18, which is electrically connected to said base plate 15 which is always at ground potential, is connected to said safety release switch pin 19 thereby closing safety release switch 13 to operate these amending switches.

Further, when said manual member 17 is rotated clockwise, said amending wheel 22 rotates and effects lifting of said amending wheel spring 24 which is electrically connected to said base plate 15 and the amending wheel protrusion 22*a* contacts the figure designative switch electrode 25 on said printed circuit board 16 whereby the figure designative switch 10 is closed.

Only the date display section 2 is displayed and another section is ceased in the first operation, and only day of the week display section is displayed in the second operation, and only the hour display section is displayed in the third operation.

Then, when said manual member 17 is rotated in counterclockwise, said manual member 17 rotates said amending wheel 22 against the biasing force of said amending wheel spring 24 so that the protrusion 22*b* contacts the electrode 26 to close the fast forward swifch 11. The fast forward operation of said hour figure according to the action of said fast forward switch is attained by said protrusion 22*b* which contacts to said switch electrode 26 on said printed circuit board 16.

After the amendment of the time is completed, and is rotated said manual member to the starting position, said manual member 17 is returned to the starting position together with the click action. At that time, said switch spring 18 breaks contact with said safety release switch pin 19 by the end portion 17*d* of said manual member 17.

When said manual member 17 is pushed inwardly, said switch spring 18 contacts said reset switch pin 20 by said end portion 17*d* via said amending wheel 22 together with the twisting of said return spring 23 by said manual member 17. The release of the figure designation (all of the figures are displayed in this embodiment) and said safety switch is activated by said reset switch 12. If said manual member 17 is freed at this time, said manual member 17 is returned to the normal rest state.

If the operator wish the zero returning of the second range, after pulling said manual member 17 and setting said safety release switch 13, the operator then pushes said manual member so that said second display section 6 is returned to zero. Furthermore, to effect lighting of said lamp, after pushing said manual member 17 from its normal state, said lamp switch 14 is activated by the contact of said switch spring 18 with said lamp switch pin 21. At that time, said switch spring 18 contacts said reset switch 12, but said reset switch 12 is not activated because said safety release switch 13 is not closed. Thus according to this invention, said safety release switch 13, said figure designative switch 10, said fast forward switch 11, said reset switch 12 and said lamp switch 13 are all operated in response to movement of said manual member 17.

Further the functions of the fast forward amendment of each figure, the zero return of "second" time and the lighting of said lamp are easily and instanteneously attained. Therefore, there is no misamendment or misadjustment because the operation of said safety release switch is included in the amending operation, and said operation is easy to accomplish because said operation is the same as that of a mechanical watch of the conventional type.

Figure 5:
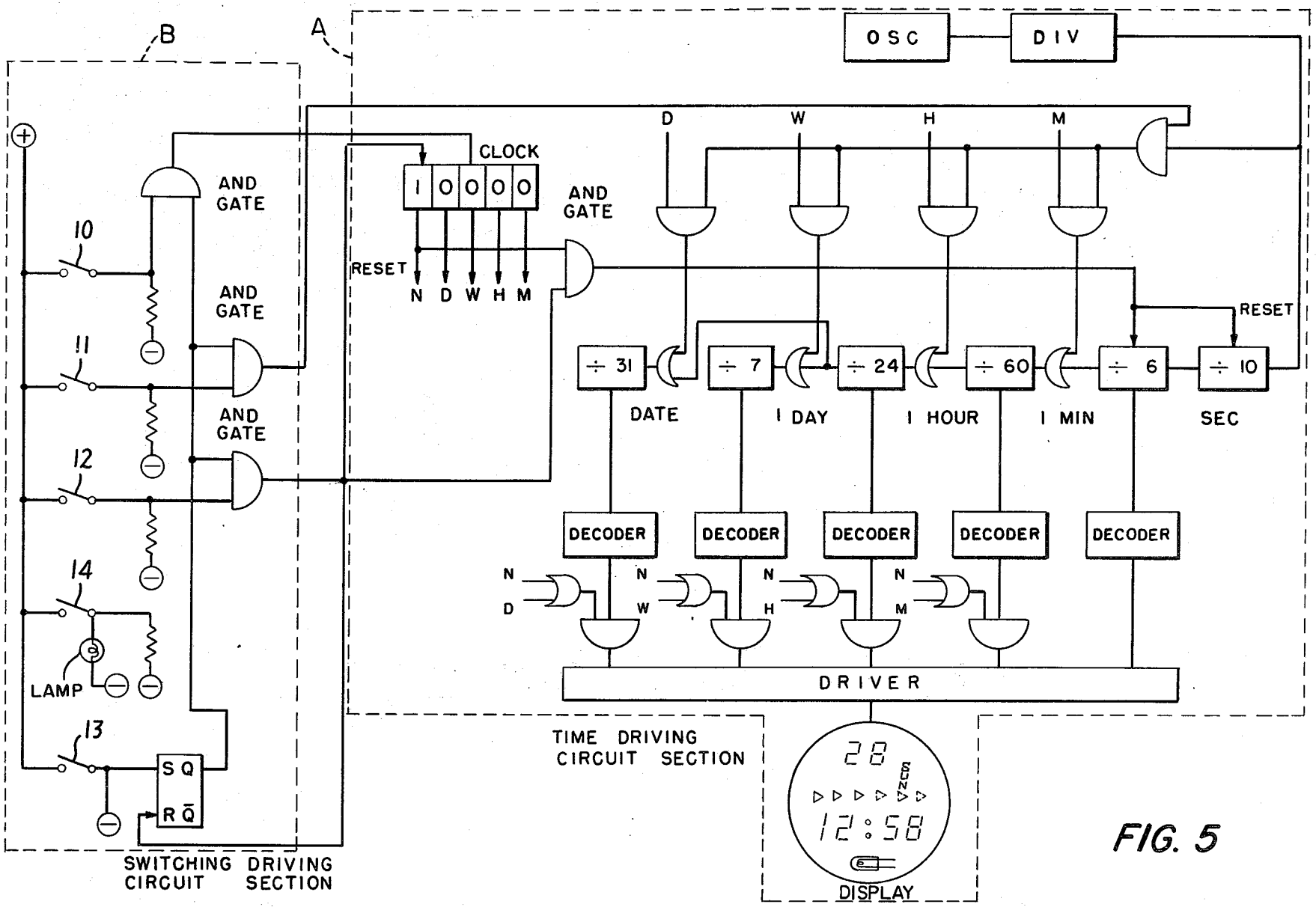
FIG. 5 shows a circuit diagram of an electronic timepiece embodying the invention.

FIG. 5 shows a circuit diagram of the inventive switching system in combination with an electronic timepiece and the electronic timepiece circuitry which is indicated with the dotted line A is a prior art circuit of known construction. The circuit block which is indicated with the dotted line B is the switching circuit of the present invention.

The marks in the FIG. 5 circuit diagram have the following meaning: N: neutral signal for indicating the time of D, W, H and M of the preset time; D: date signal; W: day of a week signal; H: hour signal; and M: minute signal.

The operation of the switching function is as follows.

First of all, the safety release switch SW 13 is closed, then the figure designative switch SW 10 is closed whereby one of the display of D, W, H and M is sequentially designated by closing the designative SW 10, and the fast forward of the designated figure is fast forwarded by closing the fast forward switch SW 11.

Then the reset switch SW 12 is closed whereby the second display function is stopped and the time which is adjusted is displayed on the display plate, and the logic circuit of SQ and RQ is resetted.

Therefore, the fast forward of D, W, H and M is sequentially and respectively designated, and is attained.

When using a timepiece in a dark place, the lamp is illuminated by the operation of the lamp SW 14.

What we claim is:

1. A switching system for an electronic timepiece comprising in combination: an electrically conductive base plate member; a rotary shaft mounted for rotary and axial movement on said base plate; a turnable wheel member having two spaced end portions and connected to said shaft for rotary movement therewith; a printed circuit board connected to said base plate; a pair of electrodes affixed to said printed circuit board in a position to make electrical contact with respective ones of said end portions of said wheel member in response to turning of said wheel member in opposite directions; a spring lever member composed of electrically conductive material mounted on said base plate; three contact pin members mounted on said base plate and having no electrical connection to said base plate; said wheel member, electrodes and contact pin members being positioned such that electrical contact between respective ones of said pair of electrodes and said wheel member is effected in response to rotary movement of said shaft and the electrical contact between respective ones of said three contact pin members and said spring lever member is effected in response to axial movement of said shaft.

2. A switching system for an electronic timepiece according to claim 1; including means mounting said spring lever member so that it makes electrical contact with said three contact pins in response to axial movement of said shaft.

* * * * *